United States Patent [19]

Orikasa et al.

[11] Patent Number: 4,555,286

[45] Date of Patent: Nov. 26, 1985

[54] APPARATUS FOR AND A METHOD OF REPAIRING BY FILLING WITH AN ADHESIVE

[75] Inventors: Wataru Orikasa; Kunio Tochimoto; Tomoyuki Mori; Masayoshi Shigetomi; Katsuji Yamaga; Masaaki Matsui; Hiroshi Saito, all of Tokyo, Japan

[73] Assignees: Nippon Telegraph and Telephone Public Corporation; Sho-Bond Construction Co., Ltd.; Communication Architecture and Building Research Corporation, all of Tokyo, Japan

[21] Appl. No.: 670,843

[22] Filed: Nov. 13, 1984

[30] Foreign Application Priority Data

Aug. 17, 1984 [JP] Japan ..... 59-171315

[51] Int. Cl.[4] ..... B32B 35/00

[52] U.S. Cl. ..... 156/94; 141/1; 141/114; 156/349; 156/578; 222/213; 222/215; 264/36; 404/107; 425/13; 427/140

[58] Field of Search ..... 141/1, 114, 25, 351; 156/94, 349, 578; 222/92, 105, 107, 213, 215, 632, 633; 264/36; 404/107; 425/12, 13; 427/140

[56] References Cited

U.S. PATENT DOCUMENTS

| | | | |
|---|---|---|---|
| 926,129 | 6/1909 | Murrie | 425/13 X |
| 1,926,415 | 9/1933 | Wertz | 425/13 |
| 3,255,788 | 6/1966 | Cook | 141/25 |
| 4,132,516 | 1/1979 | Story | 156/94 X |
| 4,245,970 | 1/1981 | St. Onge | 425/13 |
| 4,280,861 | 7/1981 | Schwartz | 156/94 X |
| 4,385,015 | 5/1983 | Klettke | 264/36 |

FOREIGN PATENT DOCUMENTS

| | | | |
|---|---|---|---|
| 1948492 | 11/1970 | Fed. Rep. of Germany | 141/351 |

*Primary Examiner*—Robert A. Dawson

*Attorney, Agent, or Firm*—Armstrong, Nikaido, Marmelstein & Kubovcik

[57] ABSTRACT

An adhesive filler apparatus is disclosed comprising an injector and a support portion, the injector comprising a pressure buffer tube made of an elastic material and check valves adjacent both ends of the pressure buffer tube, the support portion comprising a base member and a projection. The adhesive filler apparatus disclosed is used as follows: A hose connected to a pump is coupled to one end of the pressure buffer tube so that the nozzle of the hose presses the check valve to clear its closure, allowing an adhesive to be fed in the pressure buffer tube. The hose is disconnected from the fed and swollen tube, causing the check valve to close the end of the tube. The fed injector is coupled to the support portion fixed on the crack developed in a concrete structure, etc., whereupon the projection on the support portion presses the check valve to open the end of the tube, thereby allowing the adhesive in the tube to be filled in the crack by gradual and continuous contraction of the elastic tube. Where the quantity of adhesive reserved in the tube is not enough, adhesive can be supplemented in the tube through the other end of the tube left idle so that the injector need not be detached from the crack for supplementation of adhesive in the tube.

6 Claims, 8 Drawing Figures

APPARATUS FOR AND A METHOD OF REPAIRING BY FILLING WITH AN ADHESIVE

BACKGROUND OF THE INVENTION

The invention relates to a method of and an apparatus for filling an adhesive in the cracks developed in a concrete structure, or in gaps developed between a concrete structure and the outer material, or other like portions of a structure to be repaired.

Cracks developed in structures made of concrete or stones are generally repaired by filling putty or adhesive therein.

Recently a method was proposed whereby adhesive supply pipes are fixed along the cracks at appropriate space intervals with the remaining spaces sealed and, upon hardening of the sealing material, said pipes are coupled to a supply pump to fill adhesive in the cracks (Japanese Pat. No. 251791).

While cracks can be effectively repaired according to this method, some difficulties are encountered in the operation. For example, increase in the rate at which adhesive is filled in the cracks may cause increase in the pressure applied to the cracks owing to the viscosity of the adhesive and thus the hardened sealing material may be ruptured or the cracks widened. Therefore according to such method, adhesive must be filled at as slow a rate as 3 to 5 minutes per one adhesive-filled portion and thus workmanship is required.

To eliminate those drawbacks, another method was recently proposed whereby adhesive is reserved temporarily in a pressure buffer portion to deaden the pressure applied to the adhesive-filled portion such as cracks, whereupon the reserved adhesive is filled by the gradual and continuous contraction of said pressure buffer portion (Japanese Patent Kokai No. 2367/1981). This was followed by proposal of an adhesive filler apparatus to be used in said second method, which apparatus is equipped with a check valve device for preventing the adhesive from flowing backward (Japanese Patent Kokai No. 87866/1982).

The last-mentioned apparatus made an automatic adhesive filling possible utilizing elasticity of the rubber-made adhesive reserver tube in the pressure buffer portion, which tube, fed with adhesive, can contract of itself gradually and continuously, resulting in considerable reduction of hands required. Further, filling of adhesive into as minute cracks as less than 0.2 mm wide, which was possible only with difficulty, was made practicable. Consequently, it was also made possible to fill adhesive as deep as to the cracks caused, for example, between concrete and the reinforcement steel bars. Meantime, however, the method required the operator to attach a hose connected with a pump to, and, after feeding the apparatus with adhesive, detach the hose from, the apparatus in such high, unstable position as on a trestle, ladder or the like as when repairing the underside of a bridge.

In order to eliminate such drawbacks of the prior art apparatus and method, the present inventors proposed a new apparatus and a method in the Japanese Patent Application No. 238973/1983.

The apparatus proposed therein comprises an injector and a support portion, said injector including a pressure buffer tube, a coupler member adjacent one end of said tube and a check valve between said tube and the coupler member, the other end of said pressure buffer tube being closed, said support portion having a coupler projection which can be easily fitted in said coupler member and a base member for locating the support portion on the crack, etc., said check valve, urged by the adhesive fed in the tube, closing the flow passage of the adhesive and opening said passage when pressed by said coupler member upon coupling the injector to said support portion. This apparatus obviated said drawbacks and enabled an adhesive to be filled in the cracks in concrete structure, etc. by an easy operation of feeding said injector with adhesive via said coupler member using a hose connected to a pump, etc. by pressing the check valve with the nozzle of the hose from the coupler member side, coupling the fed injector to said support portion fixed on the crack, thereby pressing the check valve to restore the passage of adhesive and allowing the adhesive to be filled in the crack. However, where the cracks, etc. require to be filled with relatively a great amount of adhesive, several such injectors have to be used thereon, one after another.

The present invention is an improvement over the last-mentioned apparatus enabling the supplementation of adhesive into the pressure buffer tube emptied without the necessity of once detaching the injector from the support portion fixed on the crack, etc.

SUMMARY OF THE INVENTION

The apparatus for filling adhesive into portions of a structure such as cracks developed in a concrete structure, etc. according to the invention comprises an injector and a support portion, said injector including an elastic pressure buffer tube, tubular coupler members provided on both ends of said tube, a check valve provided between said tube ends and said coupler members adapted to close the adhesive flow passage through said tube and the coupler member while urged by said pressure buffer tube via the adhesive fed in the tube and open the adhesive flow passage in response to the pressure exerted to the check valve from the coupler member side, said support portion including a base member and a coupler projection which has a passage through it and serves to press said check valve to open the adhesive material passage through said pressure buffer tube and the coupler member.

There is also provided according to the invention a method of filling an adhesive into cracks developed in a concrete structure, etc. using said apparatus, comprising feeding an adhesive in the pressure buffer tube through one of the coupler members so as to swell the pressure buffer tube, connecting the coupler member of the injector to the coupler projection of the support portion fixed on the cracks or the like to be repaired, whereupon one of the check valves is pressed by the coupler projection of the support portion to restore the passage through the pressure buffer tube, the coupler member and the cracks or the like to be repaired, thereby allowing the adhesive to be filled in the cracks to be repaired of a concrete structure, etc. by the gradual and continuous contraction of the elastic pressure buffer tube.

Pressing the check valve from the side of one of the coupler members causes the passage of adhesive through the pressure buffer tube and the coupler member to be restored, thereby enabling adhesive to be fed in the pressure buffer tube. When the adhesive ceases to be fed in the tube upon the tube having been swollen to some extent, the check valve is actuated to close said passage of adhesive in response to the pressure caused by the pressure buffer tube which tends to return to its normal shape. The other side of the pressure buffer tube is provided with a line check valve and coupler member. Such structure enables a totally novel method of filling an adhesive into cracks of concrete structure whereby adhesive can be supplemented in the pressure buffer tube without the necessity of once detaching the injector from the cracks, etc.

BRIEF DESCRIPTION OF THE INVENTION

DETAILED DESCRIPTION OF THE PREFERRED EMBODIMENTS

The invention will be described in detail below with reference to the attached drawings.

Figure 1:
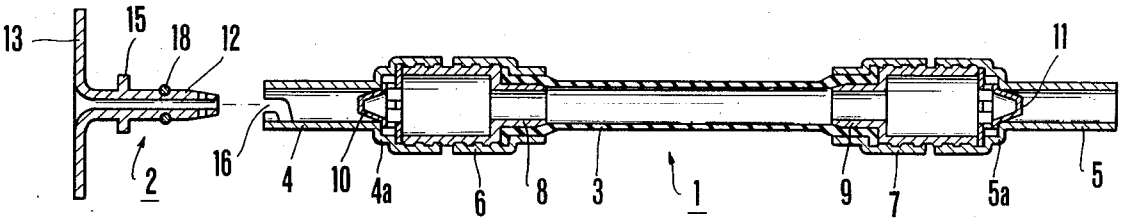
FIG. 1 is a cross section showing the structure of the support portion and the injector.

Referring to FIG. 1, an injector 1 comprises a pressure buffer tube 3, coupler members 4, 5 provided on both ends of the tube 3, and check valves 10, 11 provided between both ends of the tube 3 and said coupler members.

The pressure buffer tube 3 is made of elastic material such as rubber so as to be capable of being swollen. One of the thickened ends of the tube 3 is fitted and held between the inner surface of an outer cylindrical member 6 and the outer surface of an inner cylindrical member 8. The inner cylindrical member 8 extends longer than the outer cylindrical member 6 outwardly. The inner and outer cylindrical members 6, 8 are firmly united with each other by engaging the thread formed on the outer surface of the inner cylindrical member 8 with the thread formed on the inner surface of the outer cylindrical member 6. The other thickened end of the pressure buffer tube 3 is held by an outer cylindrical member 7 and an inner cylindrical member 9 in like manner.

The free end of the coupler members 4, 5 has an inner diameter which permits a coupler projection 12 of a support portion to be described to be tightly fitted therein. The other ends or the inner ends of the coupler members 4, 5 have steps 4*a*, 5*a* respectively from which extend tubular portions with a threaded inner surface and an inner diameter which allows said inner cylindrical members 8, 9 to be fitted therein by thread engagement. The coupler members, and the inner and outer cylindrical members may be made of any feasible materials such as metal or synthetic resin. Also the pressure buffer tube may be made of any appropriate material so long as it is capable of being swollen.

Figure 3:
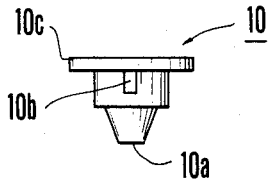
FIG. 3 shows a check valve.

As best shown in FIG. 3, a check valve 10 is made of deformable synthetic resin into a cup-like shape with a closure head 10*a* serving to shut the adhesive material passage and a peripheral wall possessing flow apertures 10*b*. The check valve 10 is further provided with a brim 10*c*. The check valve 10 is located in the apparatus by placing said brim 10*c* between the step 4*a* of the coupler member 4 and the end surface of the inner cylindrical member 8. The other check valve 11 is made and located in the injector in like manner.

The check valves may be of any other feasible type. For example, ball valves may be used, in which case, needless to say, the manner in which the coupler members are connected to both ends of the pressure buffer tube varies from that according to the present embodiment.

A support portion 2 comprises a base member 13 to be fixed on the crack of a concrete structure, etc. and the coupler projection 12 on which the coupler member 4 of the injector 1 is tightly fitted. The coupler projection 12 has a passage through it and protrusions 14 to be engaged in cuts 16 formed in the coupler member 4. The coupler projection 12 is provided with a rubber-made O-ring which serves as a packing in the connection with the coupler member 4. The base member 13 and the coupler projection 12 may be made of any feasible material such as metal or synthetic resin.

While according to the embodiment, the coupler members 4 and 5 are of different forms from each other, they may possess the same form. Where, for example, both coupler members have the form of the member 5, the support portion 2 need only be so formed as to be fitted in the coupler member 5. For example, the protrusions 14 are omitted.

Figure 2:
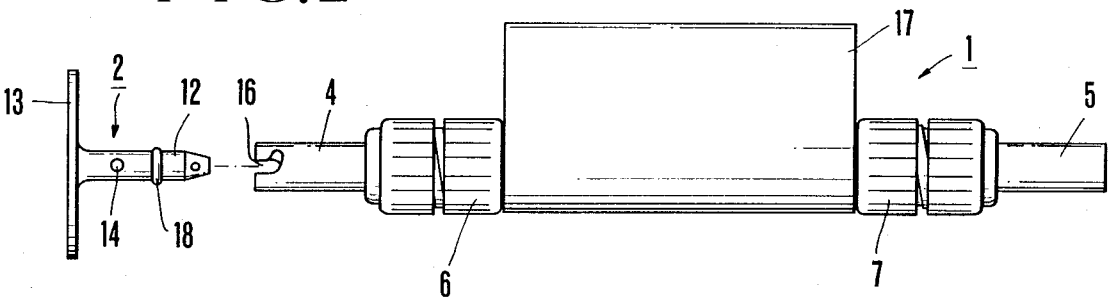
FIG. 2 shows the support portion, and the injector provided with a sheath around it.

FIG. 2 shows said embodiment as provided with a sheath 17 around the pressure buffer tube 3. The sheath 17 has a diameter corresponding to that of the tube 3 as swollen to a given extent after being fed with adhesive.

Figure 4:
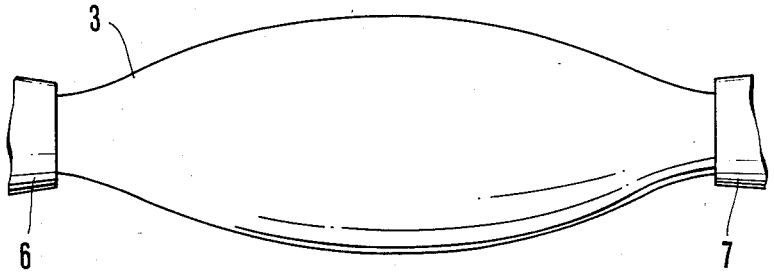
FIG. 4 shows a pressure buffer tube of the injector swollen by the adhesive fed therein.
Figure 5:
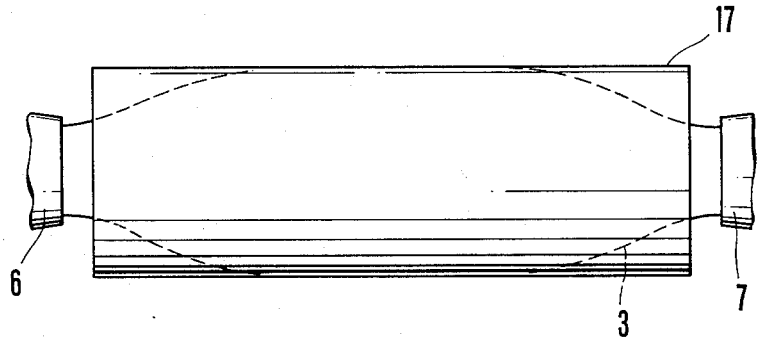
FIG. 5 is a similar view to FIG. 4 except for the sheath provided around the pressure buffer tube.

An adhesive is fed in the pressure buffer tube 3 through one of the coupler members 4, 5 using a filler gun, pump or the like. The adhesive is allowed to be fed in the tube 3 upon pressing the closure head 10*a*, for example, of the check valve 10 by means of a nozzle provided at the fore-end of the hose connected to the gun, pump or the like to deform the check valve 10 so that the pressure buffer tube 3 and the coupler member 4 may communicate through the flow apertures 10 *b* formed in the peripheral wall of the check valve 10. When the adhesive has been fed in the tube 3 and the tube 3 swollen to some extent as shown in FIG. 4, the feeding operation is stopped. Where the sheath 17 is provided around the tube 3, the feeding operation is stopped when the tube 3 touches the sheath 17 as shown in FIG. 5. Upon disconnecting the hose from the coupler member 4, the check valve 10 is pressed from the tube side by the fed adhesive owing to the elasticity of the pressure buffer tube whereby the tube 3 tends to return to its original shape, thereby closing the passage of adhesive through the pressure buffer tube 3 and the coupler member 4.

Figure 6:
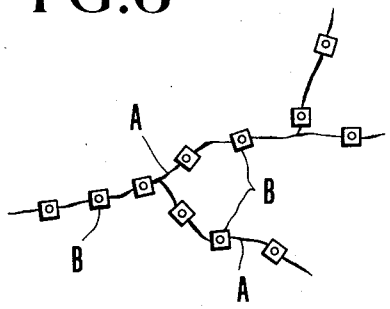
FIG. 6 is a top plan view diagrammatically showing the apparatus according to the invention applied to cracks developed in a concrete structure.
Figure 7:
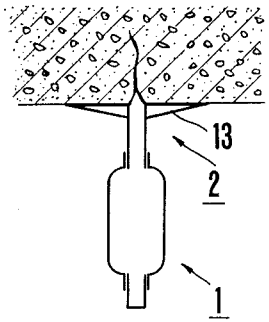
FIG. 7 is an elevation diagrammatically showing one of the apparatus shown in FIG. 6.
Figure 8:
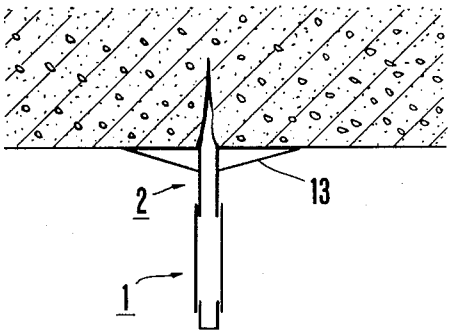
FIG. 8 is a diagrammatical view showing the apparatus according to the invention of which the pressure buffer tube has contracted after filling the adhesive in the crack.

FIG. 6 shows thus-fed apparatus B according to the invention as fixed on cracks A of a concrete structure spaced from one another at intervals of about 20 to 40 cm. FIG. 7 better shows the manner in which each of these apparatus B is fixed on the crack. Specifically the base member 13 of the support portion 2 is first secured on the crack by means of putty while the remaining portions of the cracks between the support portions are sealed by putty. Subsequently the injector 1 is connected to the coupler projection 12 of the support portion through the coupler member 4, whereupon the fore-end of the coupler projection 12 presses the closure head 10*a* of the check valve 10 so as to deform the check valve 10. As a result, the pressure buffer tube 3 communicates with the coupler member 4 through the flow apertures 10*b*, so that the adhesive is filled in the cracks A owing to the gradual and continuous contraction of the pressure buffer tube 3. Upon termination of filling, the pressure buffer tube 3 assumes the shape as shown, for example, in FIG. 8.

When the quantity of adhesive fed in the injector 1 is not enough to repair the cracks of a concrete structure of the like, adhesive may be supplemented in the tube 3, with the injector 1 mounted on the crack, through the coupler member 5 in a similar manner to that mentioned in which adhesive is fed in the tube 3 through the coupler member 4. The adhesive thus supplemented in the tube 3 can be filled in the crack in the manner mentioned.

Using the adhesive filler apparatus of the invention, since the pressure buffer tube is provided at both ends with the valve devices which normally provide a closure, the quantity of the adhesive fed in the pressure buffer tube can be checked so that the quantity filled into the cracks developed in a concrete structure, etc. can be known by comparing the quantity fed with the pressure buffer tube with the quantity left therein after filling the adhesive into the cracks, etc., for example, by weighing the pressure buffer portion before and after filling adhesive into the cracks, etc.

Further an on-the-spot adhesive filling operation by means of a pump is made unnecessary since a plurality of adhesive filler apparatus according to the invention can have been fed with adhesive in advance. Also a quantity of adhesive expected to be required can be prepared by feeding a corresponding number of adhesive filler apparatus beforehand.

An excellent performance is another benefit of the apparatus according to the invention, in which a closure provided by the valve device is cleared upon connecting the injector to the support portion with its base member previously located on the cracks of buildings, etc., and upon clearing of the closure, the adhesive is filled in the cracks, etc. by gradual and continuous contraction of the pressure buffer tube.

Also, where the sheath is provided around the pressure buffer tube, the quantity of adhesive fed in the pressure buffer tube can be controlled and a possible rupture of the pressure buffer tube due to overfeeding can be prevented.

Further the apparatus according to the invention permits of various methods in which to fill adhesive in the cracks, etc. because of its structure in which the pressure buffer tube is provided on both ends with a coupler member having a check valve. According to one of the methods, the injector fed with adhesive is connected to the support portion previously fixed on cracks of a concrete structure, etc., thereby allowing the adhesive to be filled in the portion to be repaired by the continuous and gradual contraction of the pressure buffer tube. According to another method, the injector with the pressure buffer tube empty may be connected to the support portion through one of the coupler members, whereupon an adhesive is fed in the pressure buffer tube through the other coupler member, allowing the adhesive to be filled in the portion to be repaired. Another and an especially important is the method described above whereby in the event the quantity of adhesive which can be reserved in the pressure buffer tube is not enough to fill the portion to be repaired, adhesive can be supplemented, without the necessity of detaching the injector from the support portion, through the coupler member left idle.

While the invention is described above as applied to cracks on concrete structures, it may also be applied to repair the gaps developed between a concrete structure and the outer material made of mortar, or other like portions of a structure which can be repaired by filling adhesive therein.

We claim:

1. An apparatus for filling an adhesive in the portions of a structure to be repaired by filling an adhesive therein, comprising an injector and a support portion, said injector including a pressure buffer tube with coupler members at both ends thereof and check valves between both ends of said pressure buffer tube and said coupler members, said check valves being so actuated by the pressure from the pressure buffer tube as to close the passage of adhesive through the pressure buffer tube and the coupler member while said check valves being so actuated by the pressure from the coupler member side as to open said passage, said support portion including a coupler projection and a base member, said coupler projection having a passage therethrough and serving to press one of said check valves upon connecting said injector to said support portion to restore said passage of adhesive.

2. An apparatus according to claim 1, which is provided with a sheath around the pressure buffer tube having a larger diameter than the pressure buffer tube.

3. A method of filling an adhesive in the portion of a structure to be repaired by filling an adhesive therein, using the apparatus as described in claim 1, comprising feeding an adhesive in the pressure buffer tube through one of the coupler members so as to swell the pressure buffer tube, connecting the coupler member of the fed injector to the coupler projection of the support portion fixed on the portion of a structure to be repaired, whereupon one of the check valves is pressed by the coupler projection of the support portion to restore the passage through the pressure buffer tube, the coupler member and the portion of a structure to be repaired, thereby allowing the adhesive to be filled in the portion of a structure by the gradual and continuous contraction of the pressure buffer tube.

4. A method of filling an adhesive in the portion of a structure to be repaired by filling an adhesive therein, using the apparatus as described in claim 2, comprising feeding an adhesive in the pressure buffer tube through one of the coupler members so as to swell the pressure buffer tube until it touches the sheath around it, connecting the coupler member of the fed injector to the coupler projection of the support portion fixed on the portion of a structure to be repaired, whereupon one of the check valves is pressed by the coupler projection of the support portion to restore the passage through the pressure buffer tube, the coupler member and the portion of a structure to be repaired, thereby allowing the adhesive to be filled in the portion of a structure by the gradual and continuous contraction of the pressure buffer tube.

5. A method according to claim 3, further comprising supplementing adhesive in the pressure buffer tube through the coupler member left idle by pressing the check valve so as to swell the pressure buffer tube, thereby filling the adhesive in the cracks or the like of a structure by the gradual and continuous contraction of the pressure buffer tube.

6. A method according to claim 4, further comprising supplementing adhesive in the pressure buffer tube through the coupler member left idle by pressing the check valve so as to swell the pressure buffer tube, thereby filling the adhesive in the cracks or the like of a structure by the gradual and continuous contraction of the pressure buffer tube.

* * * * *